US007199317B2

(12) United States Patent
Ieda et al.

(10) Patent No.: US 7,199,317 B2
(45) Date of Patent: Apr. 3, 2007

(54) VEHICLE DOOR HANDLE APPARATUS

(75) Inventors: Kiyokazu Ieda, Chiryu (JP); Takamasa Fujitsuna, Anjo (JP); Kazuyoshi Mori, Chita (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 31 days.

(21) Appl. No.: 11/108,811

(22) Filed: Apr. 19, 2005

(65) Prior Publication Data

US 2005/0230237 A1 Oct. 20, 2005

(30) Foreign Application Priority Data

Apr. 19, 2004 (JP) ..... 2004-122476

(51) Int. Cl.
*H01H 3/00* (2006.01)

(52) U.S. Cl. ..... 200/61.62; 200/600; 292/347

(58) Field of Classification Search ..... 200/61.62, 200/520, 600, 293.1, 61.93, 61.85; 292/347; 340/5.72, 5.62, 568.5, 522, 426, 539, 573.1, 340/825.31, 825.34, 825.69; 343/872; 180/287; 70/237, 255, 258

See application file for complete search history.

(56) References Cited

U.S. PATENT DOCUMENTS 4,293,745 A * 10/1981 Matsuda et al. ..... 200/600
6,527,316 B1 * 3/2003 Agostini et al. ..... 292/347
6,696,652 B1 * 2/2004 Spies ..... 200/61.62
6,740,834 B2 * 5/2004 Sueyoshi et al. ..... 200/600
6,871,887 B2 * 3/2005 Jooss et al. ..... 292/336.3
7,019,233 B2 * 3/2006 Spies ..... 200/61.62
7,057,124 B2 * 6/2006 Ieda et al. ..... 200/61.62

FOREIGN PATENT DOCUMENTS

JP 2003-221946 8/2003

* cited by examiner

*Primary Examiner*—Michael A. Friedhofer
(74) *Attorney, Agent, or Firm*—Buchanan Ingersoll & Rooney PC

(57) ABSTRACT

A vehicle door handle apparatus includes a door handle having an inner space therein, a first wall portion having an operation surface at an outer side thereof, and a first inner surface at an inner side thereof, the first inner surface being a part of a surface defining the inner space of the door handle; a sensor electrode positioned inside the inner space so as to face the first inner surface of the first wall portion and capable of generating electrostatic capacitance between the sensor electrode and a dielectric approaching the operation surface; and a controlling member housed within the inner space and capable of adjusting the sensor electrode to come in contact with the inner surface of the first wall portion.

18 Claims, 6 Drawing Sheets

VEHICLE DOOR HANDLE APPARATUS

CROSS REFERENCE TO RELATED APPLICATIONS

This application is based on and claims priority under 35 U.S.C. §119 with respect to Japanese Patent Application 2004-122476, filed on Apr. 19, 2004, the entire content of which is incorporated herein by reference.

FIELD OF THE INVENTION

This invention generally relates to a vehicle door handle apparatus. More specifically, this invention pertains to a vehicle door handle apparatus provided with a human approach-detecting sensor for detecting the fact that a hand (a dielectric) of a user of a vehicle is approaching a door handle of a vehicle.

BACKGROUND

Conventionally, JP2003-221946A discloses a door handle apparatus. This type of door handle apparatus is provided with a door handle and a sensor electrode. The door handle includes both an inner space defined therein and a first wall portion having both an operation surface at an outer side thereof and a first inner surface at an inner side thereof, a first inner surface which serves as a part of a surface defining the inner space in the door handle. The sensor electrode is allocated within the interior space in such a manner so as to face the first inner surface of the first wall portion, and generates electrostatic capacitance between the sensor electrode and a dielectric approaching the operation surface of the door handle. A circuit portion is electrically connected to the sensor electrode. A human approach-detecting sensor is thus configured as described above. This circuit portion can detect variations in electrostatic capacitance generated at a time that a hand of a user is approaching the operation surface of the door handle and at a time that the hand is going way therefrom, thereby recognizing the fact that the hand is approaching the door handle.

As described in JP2003-221946A, when the human approach-detecting sensor having the sensor electrode and the circuit portion detects the fact that a human hand is approaching a door handle, in order to detect the approach of a human hand to the door handle, consideration should be most highly given to variations in electrostatic capacitance detected by the circuit portion. However, variations in electrostatic capacitance heavily depend on a distance between a sensor electrode incorporated in such a sensor and a hand of a user. In the event that, due to flexure of the first wall portion of the door handle, or due to a degree of precision of attaching the sensor electrode to the first wall portion, a distance of the sensor electrode relative to the operation surface of the first wall portion fluctuates, a distance, which is defined between the sensor electrode and a hand of a user already approaching the operation surface may alter. Therefore, notwithstanding a user's hand has already approached the door handle, there is a danger of the human approach-detecting sensor of failing to detect a user's hand that has approached the door handle, thereby deteriorating a detecting performance of the human approach-detecting sensor.

The present invention has been made in view of the above circumstances, and provides a vehicle door handle apparatus, which is simply structured and can stabilize a performance of a human approach-detecting sensor in detecting a dielectric.

SUMMARY OF THE INVENTION

According to an aspect of the present invention, a vehicle door handle apparatus includes: a door handle having an inner space therein, a first wall portion having an operation surface at an outer side thereof, and a first inner surface at an inner side thereof, the first inner surface being a part of a surface defining the inner space of the door handle; a sensor electrode positioned inside the inner space so as to face the first inner surface of the first wall portion and capable of generating electrostatic capacitance between the sensor electrode and a dielectric approaching the operation surface; and a controlling member housed within the inner space and capable of adjusting the sensor electrode to come in contact with the inner surface of the first wall portion.

It is preferable that the door handle includes a second wall portion facing the first wall portion, the second wall portion having a second inner surface at an inner side thereof, the second inner surface being a part of a surface defining the inner space of the door handle, wherein the controlling member projects towards the inner space from the second wall portion.

It is further preferable that the door handle includes both a handle main body, which has the second wall portion and a recessed portion housing the sensor electrode therein, and a cover, which has the first wall portion and fixed to the handle main body so as to close the recessed portion and to define the inner space together with the handle main body.

It is still further preferable that the controlling member is an elastic member, which is in contact with the second inner surface and biases the sensor electrode towards the first inner space.

It is still further preferable that the door handle includes an antenna assembly that is allocated within the inner space and supports the sensor electrode. One end of the elastic member is in contact with the second inner surface, and the other end thereof is fixed to the antenna assembly, wherein the elastic member is a spring for biasing the sensor electrode together with the antenna assembly towards the first inner surface.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

An embodiment of the present invention will be described hereinbelow in detail with reference to the accompanying drawings.

Figure 1:
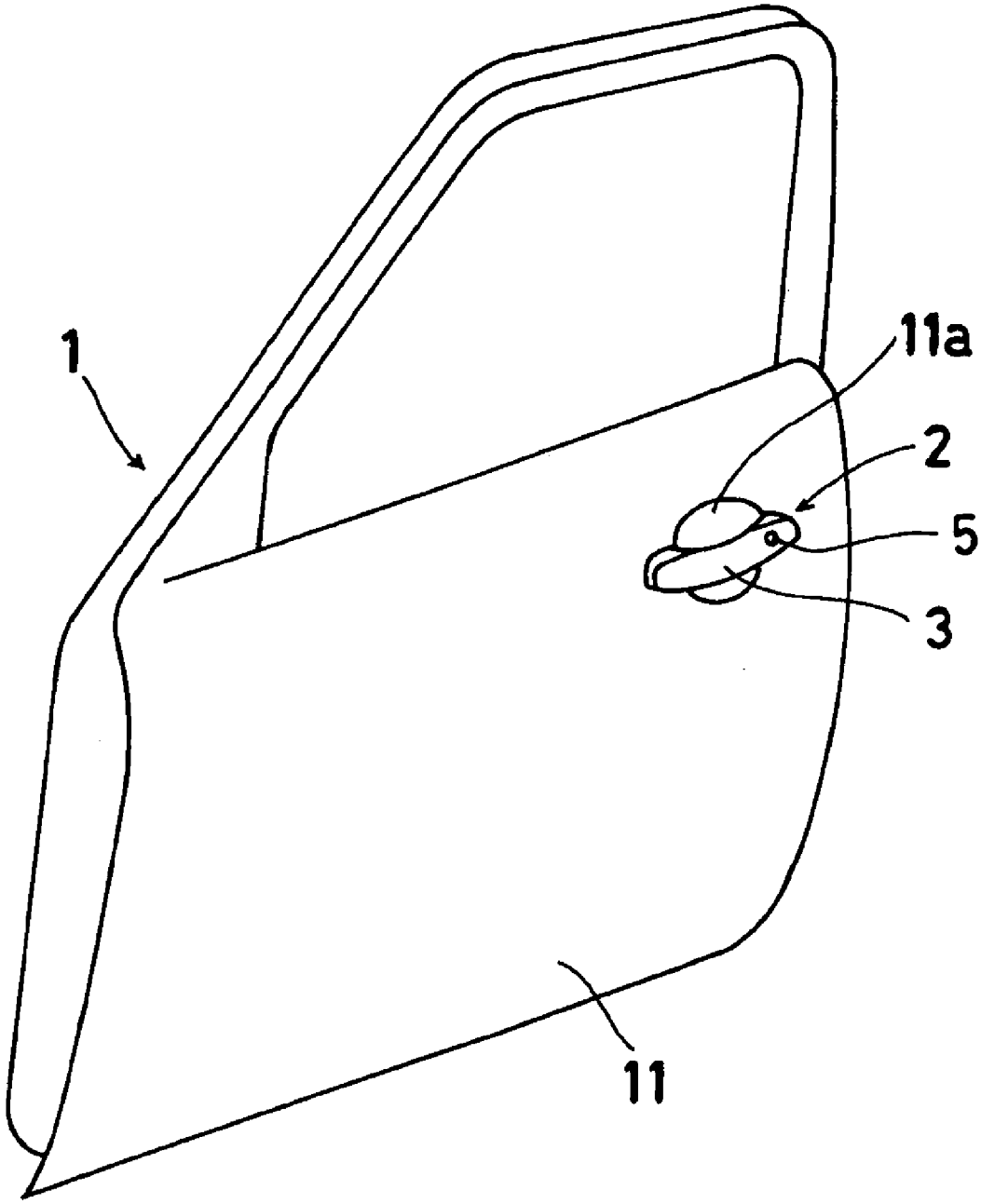
FIG. 1 is a perspective view illustrating a vehicle door on which a vehicle door handle apparatus according to an embodiment of the present invention is mounted.
Figure 3:
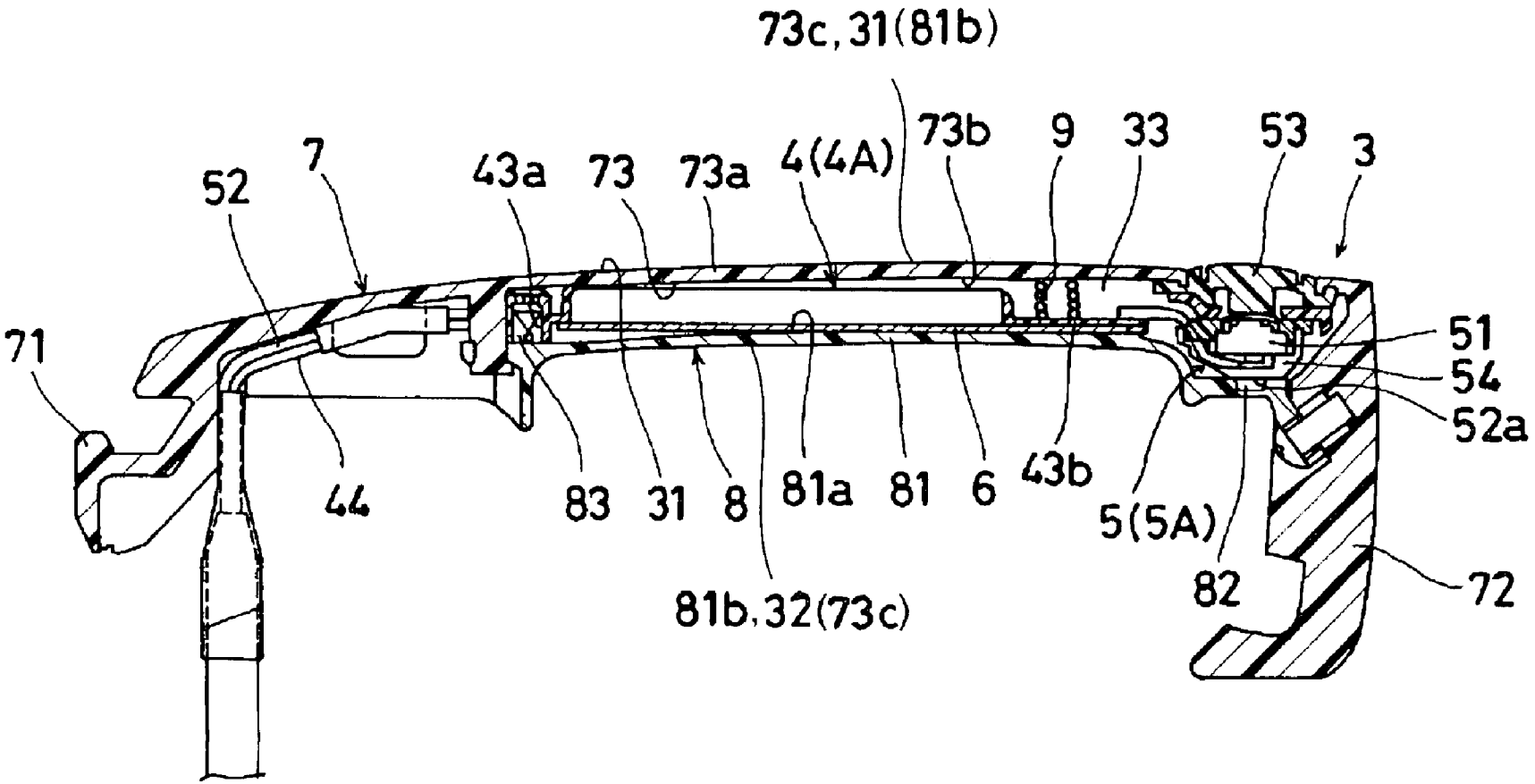
FIG. 3 is a cross sectional view taken along line □—□ in FIG. 2.

As is illustrated in FIGS. 1 and 3, a door outside handle apparatus 2 operated for opening a door 1 of a vehicle is fixed to a door outer panel 11 of the vehicle door 1, and is provided with a door handle 3 gripped by a hand of a user at a time of opening the vehicle door 1. This door handle 3 is a bar-shaped handle oriented in a door longitudinal direction (i.e., left and right directions in FIGS. 1 and 3) so as to cross a recessed portion 11*a* of the door outer panel 11. The door handle 3 produces, thereon, both a decorative surface 31 openly facing an outside of a vehicle chamber and an operation surface 32 opposite to the decorative surface 31, an operation surface 32 which comes in contact with a hand of a user.

The door handle 3 is pivotably supported by the door outer panel 11 on a rotational axis of a front end of the door handle 3 (left ends in FIGS. 1 and 3) in a manner such that a rear end of the door handle 3 (right ends in FIGS. 1 and 3) outstands towards an outside of the vehicle chamber. The door handle 3 is further linked to a door lock mechanism (not shown) at the rear end of the door handle 3, a door lock mechanism which is accommodated within the vehicle door 1 and is operated so as to maintain the vehicle door 1 closed. The door lock mechanism is operated in response to pivotal movement of the door handle 3 that is gripped by a hand of a user, whereby the vehicle door 1 can be shifted to an open state. An open state herein indicates two states; where the vehicle door 1 can be opened, and the vehicle door 1 has been open.

The door outside handle apparatus 2 is further provided with an antenna 4, which transmits a signal to a portable terminal (not shown) that is carried with a user who intends to open the vehicle door 1, a door switch 5, which activates operation of the door lock mechanism so as to control the vehicle door 1 to a locked state where the vehicle door 1 can not be altered between open and closed states, and a sensor electrode 6 which is one of components that configure a human approach-detecting sensor. The sensor electrode 6 activates operation of the door lock mechanism so as to control the vehicle door 1 to an unlocked state where the vehicle door 1 can be altered between the open and closed states. The signal is transmitted from the antenna 4 to the portable terminal so as to certify whether a hand of a user is approaching the vehicle door 3. According to the embodiment of the present invention, the antenna 4 transmits to a portable terminal a signal which requires a certification of a vehicle user approaching the door handle 3. As one of alternatives, the antenna 4 can receive a signal transmitted from a portable terminal, a signal which contains coded information. Further, according to the embodiment of the present invention, the human approach-detecting sensor is employed so as to start-up operation of the door lock mechanism, operation which is implemented for the purpose of controlling the vehicle door 1 to the unlocked state. As one of alternatives, the human approach-detecting sensor can be employed so as to start-up transmission of a signal from the antenna 4, a signal which requires a certification of a vehicle user approaching the door handle 3. Still further, according to the embodiment of the present invention, the door switch 5 is employed so as to start-up operation of the door lock mechanism, operation which is implemented for the purpose of controlling the vehicle door 1 to the locked state. As one of alternatives, the door switch 5 can be employed, for example, so as to start-up operation of the door lock mechanism for the purpose of controlling the vehicle door 1 to the unlocked state, and to start-up electrically opening and closing the vehicle door 1.

Figure 4:
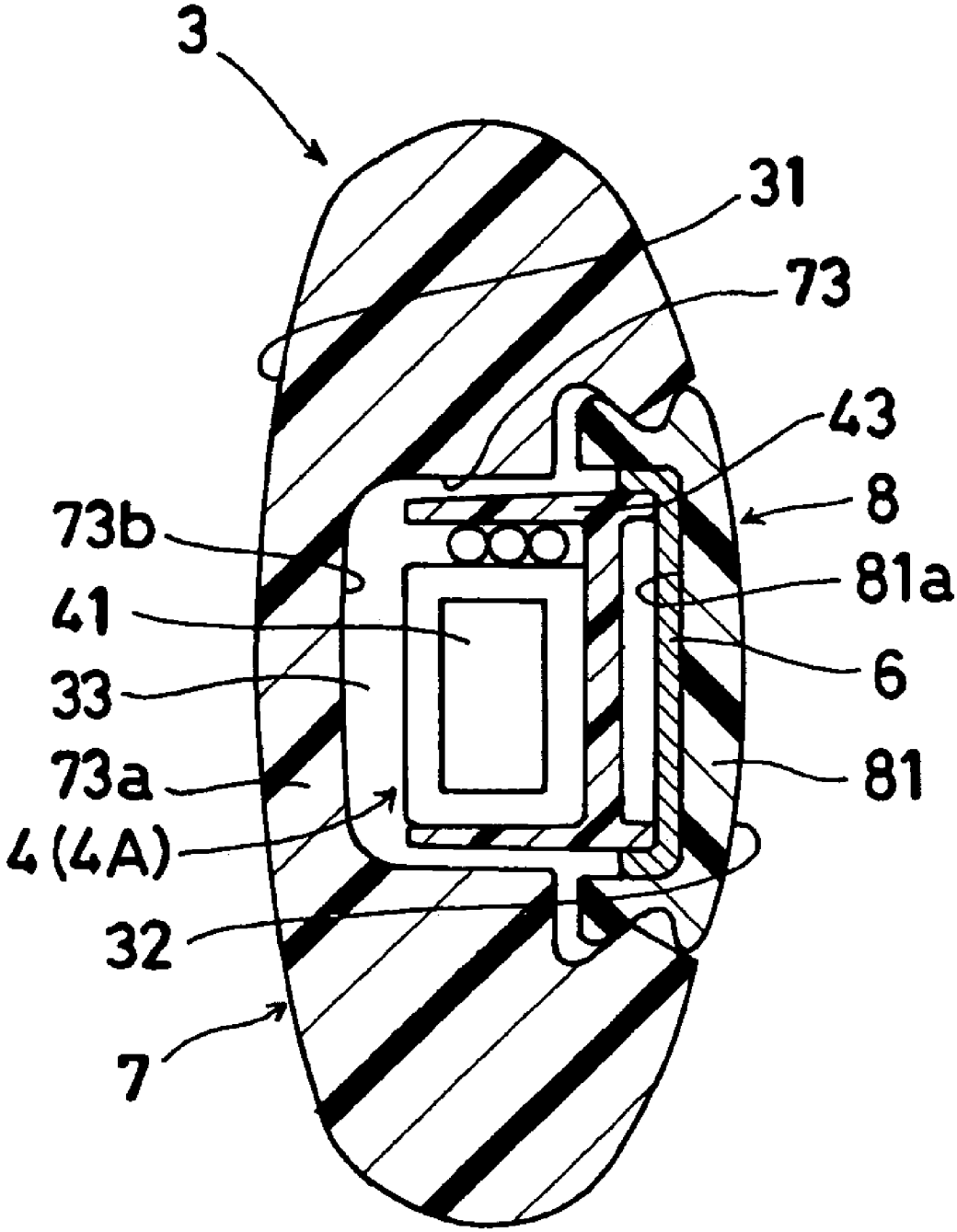
FIG. 4 is a cross sectional view taken along line □—□ in FIG. 3.

As is illustrated in FIGS. 3 and 4, the door handle 3 is mainly built with a synthetic-resin made handle main body 7 and a synthetic resin made cover 8 attached to the handle main body 7. These two components, the handle main body 7 and the cover 8, are fixedly coupled to each other in a direction from a vehicle inside towards a vehicle outside (i.e., in up-and-down directions in FIGS. 3 and 4) in such a manner that the handle main body 7 possesses the decorative surface 31 and the cover 8 possesses the operation surface 32. Accordingly, it is possible to define an inner space 33 within the door handle 3.

Figure 2:
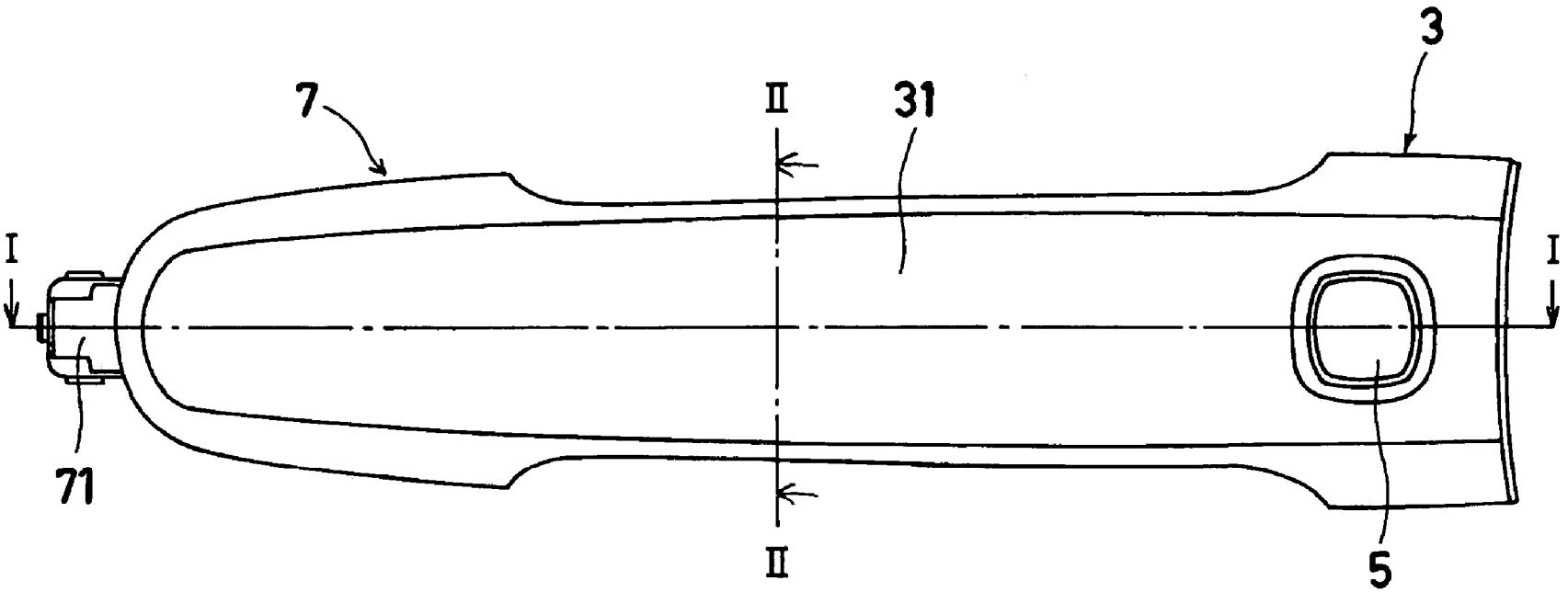
FIG. 2 is a front view illustrating the vehicle door handle apparatus according to the embodiment of the present invention.

The handle main body 7 is a bar-shaped member extending in a door longitudinal direction (i.e., the left and right directions in FIGS. 1 and 3), and is provided with a supporting leg portion 71 at a front end thereof (left sides in FIGS. 1 and 2) and an operating leg portion 72 at a rear end thereof (right sides in FIGS. 1 and 2). The supporting leg portion 71 acts as a part of a rotational axis of pivotal movement of the door handle 3, and the operating leg portion 72 acts as a connecting portion for connecting the handle main body 7 to the door lock mechanism. At an area between the supporting leg portion 71 and the operating leg portion 72, there is a recessed portion 73 defined along a door handle longitudinal direction. A bottom wall 73*a* of the bottom wall 73*a* is intended to produce, by use of an inner surface 73*b* of the bottom wall 73*a*, the inner space 33 within the door handle 3. An outer surface 73*c* of the bottom wall 73*a* produces thereon the decorative surface 31 of the door handle 3. The cover 8 is flat plate-shaped and possesses a plate portion 81 (i.e. a first wall portion) of which lateral thickness is predetermined. At the front end, the cover 8 is fastened to the handle main body 7 in such a manner of closing the recessed portion 73 of the handle main body 7. At the rear end, the cover 8 is screwed to the handle main body 7. The plate portion 81 of the cover 8 is intended to define, by use of an inner surface 81*a* (i.e. a first inner surface) of the plate portion 81, the inner space 33 within the door handle 3. An outer surface 81*b* of the plate portion 81 produces thereon the operation surface 32 of the door handle 3.

Figure 6:
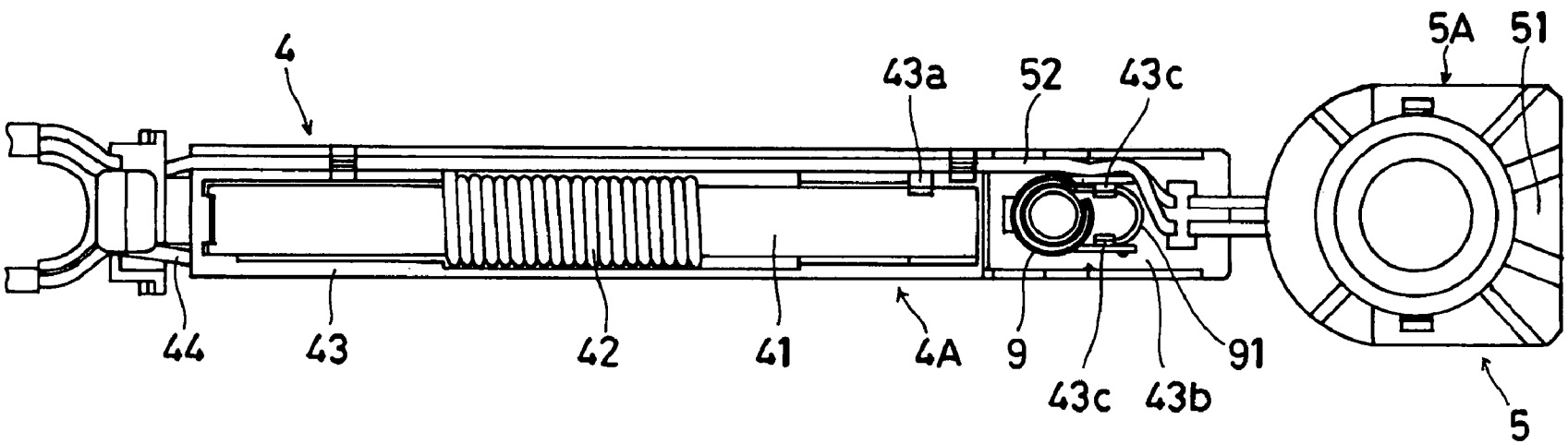
FIG. 6 is a front view illustrating the antenna assembly of the vehicle door handle apparatus according to the embodiment of the present invention.

As is illustrated in FIGS. 3 and 6, the antenna 4 incorporates, therein, a ferrite core 41, a coil 42 wound on the ferrite core 41, and a harness 44 electrically connected to the coil 42. The ferrite core 41 furnished with the coil 42 is housed within an antenna case 43, and is fastened at the antenna case 43 by pawls 43*a* integrally formed at the antenna case 43. An antenna assembly 4A is thus built as described above. This antenna assembly 4A is accommodated within the recessed portion 73 of the handle main body 7, and is allocated within the inner space 33 of the door handle 3 in such a manner that the antenna assembly 4A faces the inner surface 73*b* of the handle main body 7 and the inner surface 81*a* of the cover 8. The antenna assembly 4A can be tightly seated on the cover 8 by fitting a pin 83 protruding from the inner surface 81*a* of the cover 8 into an engagement bore 43*d* of the antenna case 43. The harness 44 of the antenna 4 extends from the front-end side (the left side in FIG. 3) of the antenna assembly 4A, and then is guided into the vehicle door 1 from a vicinity of the supporting leg portion 71.

As is illustrated in FIG. 3, the door switch 5 is made up with a push-type switch 51, a harness 52 electrically connected to the switch 51, and a push button 53 operating the switch 51. The switch 51 is housed within the switch case 54. A switch assembly 5A is thus built as described above. This switch assembly 5A is accommodated within the recessed portion 73 of the handle main body 7, and is allocated within the inner space 33 at the rear-end side of the antenna assembly 4A (the right side in FIG. 3). The switch assembly 5A can be tightly seated on the cover 8 by fitting a protrusion 52*a* protruding from the switch case 54 into a fitting bore 82 of the cover 8. The harness 52 of the door switch 5 is fixed to the antenna case 43, extends from the front-end side (the left side in FIG. 3) of the antenna assembly 4A, and then is guided into the vehicle door 1 from a vicinity of the supporting leg portion 71. The push button 53 is supported by the bottom wall 73*a* of the handle main body 7 so as to be exposed outwards from the decorative surface 31 of the door handle 3. In response to manual operation of the push button 53 by a hand of a vehicle user, the push-type switch 51 is operated.

Figure 5:
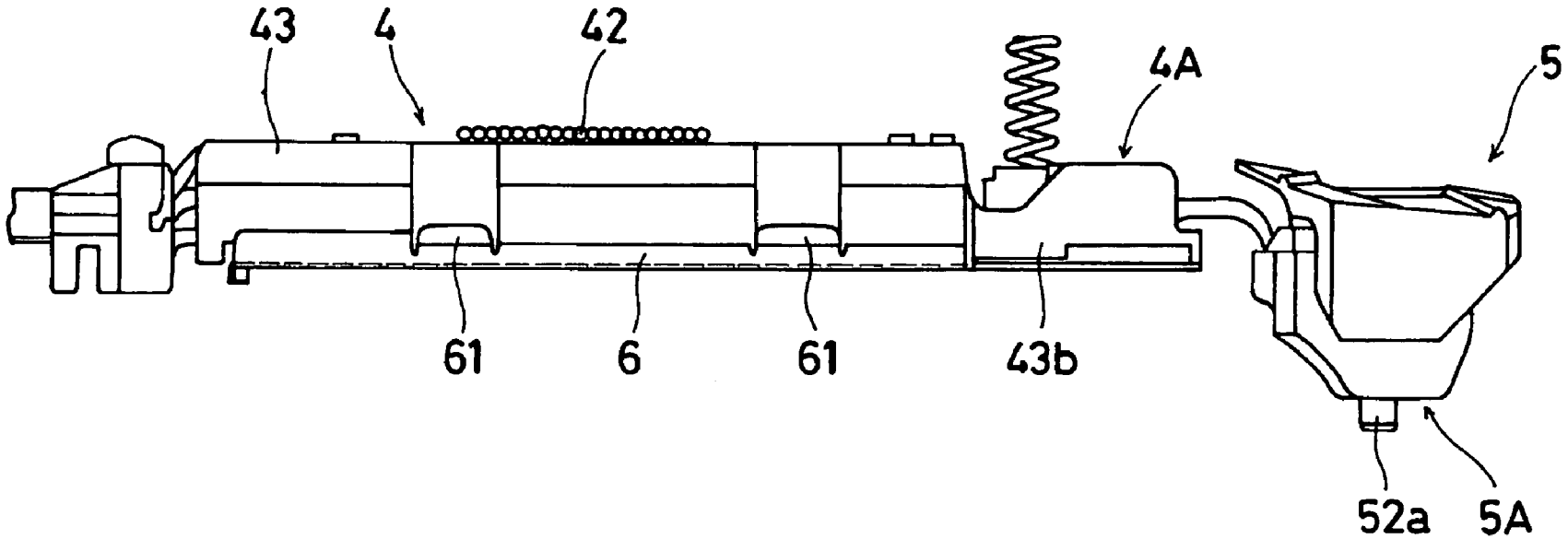
FIG. 5 is a side view illustrating an antenna assembly of the vehicle door handle apparatus according to the embodiment of the present invention.

As is illustrated in FIGS. 3 and 5, the sensor electrode 6 is allocated within the inner space 33 of the door handle 3. This sensor electrode 6 is formed with a conductive plate or a metal-coated plate, and is positioned between the cover 8 and the antenna assembly 5A in such a manner of facing the inner surface 81*a* of the cover 8. Moreover, this sensor electrode 6 is supportably fastened to the antenna case 43 by means of plural flange portions 61 integrally formed at a longitudinally side edge of the sensor electrode 6. Still moreover, the sensor electrode 6 is connected to a detecting circuit (not shown) via a harness. The sensor electrode 6, the harness and the detecting circuit thus makes up a human approach-detecting sensor.

As is illustrated in FIGS. 3, 5 and 6, a flange portion 43*b* is integrally formed at the rear end (the right end in FIG. 3) of the antenna case 43, and protrudes in a rearward direction. A coil spring 9 (i.e., a controlling member, an elastic member) is mounted on the flange portion 43*b*, and extends in a vehicle lateral direction, (i.e., up-and-down directions in FIGS. 3 and 5). The coil spring 9 is in contact, at one end thereof, with the inner surface 73*b* of the bottom wall 73*a*, and is fixed, by means of pawls 43*c*, to the flange portion 43*b* at a bent portion 91 defined at the other end thereof. This coil spring 9 protrudes towards the inner space 33 of the door handle 3, and generates force for biasing the antenna assembly 4A and the sensor electrode 6 towards the inner surface 81*a* of the plate portion 81 of the cover 8. Therefore, the sensor electrode 6 can be maintained in contact with the inner surface 81*a* with substantially no gap therebetween, and supported by the cover 8, thereby maintaining at a predetermined amount a distance between the sensor electrode 6 and the operation surface 32 of the door handle 3 by a thickness of the plate portion 81 of the cover 8. Further, the coil spring 9 can also bias the antenna assembly 4A towards the cover 8. Still further, the coil spring 9 can bias the cover 8 towards the handle main body 7. Therefore, according to the embodiment of the present invention, even if the handle door 3 is divided into the cover 8 having the operation surface 32 and the handle main body 7 having the recessed portion, the coil spring 9 can absorb a mounting error of the antenna assembly 4A relative to the cover 8 and a mounting error of the cover 8 relative to the handle main body 7, wherein it is possible to position and support, with high assembling precision, the sensor electrode 6 relative to the operation surface 32. As described above, the coil spring 9 is fastened to the antenna case 43 via the other end of the coil spring 9. Therefore, when the door handle 3 is assembled, as far as, after the antenna assembly 4A attached with the coil spring 9 is supported by the cover 8, the cover 8 is screwed to the handle main body 7 while the one end of the coil spring 9 is being in contact with the inner surface 73*b* of the handle main body 7, the coil spring 9 can spontaneously generate force for biasing the sensor electrode 6 and the antenna assembly 4 to the inner surface 81*a* of the cover 8. As described above, it is possible to facilitate mounting the coil spring 9 at the inner space 33 of the door handle 3, thereby enabling to avoid dropping and losing of the coil spring 9 and to facilitate an assembling work of the door handle 3. As a result, it is possible it is possible, only with a protrusion that brings the sensor electrode 6 to come in contact with the inner surface 81*a*, to reliably stabilize a performance of the human approach-detecting sensor in detecting a dielectric.

Next, described below is operation of the human approach-detecting sensor in combination with the sensor electrode 6.

The sensor electrode 6 in general generates electrostatic capacitance relative to the door outer panel 1 of the vehicle door 1. When a user of a vehicle grips the door handle 3 for purposes of opening the vehicle door 1, it is assumed that a user of a vehicle has approached the door handle 3 and has located relative thereto at a distance at which the user is in contact with the operational surface 32 of the door handle 3, or can touch the operation surface 32 thereof. In such circumstances, the sensor electrode 6 generates electrostatic capacitance between the sensor electrode 6 and a hand of the user, and the detecting circuit detects variations in the electrostatic capacitance that was generated by the sensor electrode 6. As described above, the human approach-detecting sensor detects, on the basis of these variations of electrostatic capacitance, the fact that the hand of the user has approached the door handle 3. Especially because the cover 8 is made of resin, when a user of a vehicle grips the door handle 3, the cover 8 on occasions is bent, and as a result, a volume of the inner space 33 is reduced. In this case, because a biasing force of the coil spring 9 has maintained a distance between the sensor electrode 6 and the operation surface 32 at a constant amount, even when the cover 8 is bent, there is no danger of a distance between the sensor electrode 6 and a hand of a user touching the operation surface 32 of fluctuating. Namely, the distance between the operation surface 32 and the sensor electrode 6 can be maintained fixed with improved reliability. Therefore, it is possible to stabilize a detecting performance of the human approach-detecting sensor.

According to the embodiment of the present invention, the sensor electrode 6 is supported by the antenna assembly 4A. However, in an event that the antenna assembly 4A has not been assembled, the sensor electrode 6 can be supported directly by the cover 8. In this case, the coil spring 9 is fixed to the sensor electrode 6.

According to the embodiment of the present invention, the decorative surface 31 is formed at an outer surface 73*c* of the bottom wall 73*a* of the handle main body 7, and the operation surface 32 is formed at the outer surface 81*b* of the plate portion 81 of the cover 8. However, it is still applicable that the operation surface 32 is formed on the outer surface 73*c*, and the decorative surface 32 is formed on the outer surface 81*b*.

According to the embodiment of the present invention, the coil spring 9 can be substituted by a leaf spring, or by an elastic protrusion integrally formed at the inner surface 73*b* of the handle main body 7 and protruding towards the inner space 33. Further, as far as the sensor electrode 6 can be biased on or towards the inner surface 81*a* of the cover 8, such a protrusion is not necessarily required to possess an elastic attribute, and can simply protrude from the inner surface 73*b* towards the inner space 33.

The principles, the preferred embodiment and mode of operation of the present invention have been described in the foregoing specification. However, the invention, which is intended to be protected, is not to be construed as limited to the particular embodiment disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents that fall within the spirit and scope of the present invention as defined in the claims, be embraced thereby.

The invention claimed is:

1. A vehicle door handle apparatus comprising:

a door handle having an inner space therein, a first wall portion having an operation surface at an outer side thereof, and a first inner surface at an inner side thereof, the first inner surface being a part of a surface defining the inner space of the door handle;

a sensor electrode positioned inside the inner space so as to face the first inner surface of the first wall portion and capable of generating electrostatic capacitance between the sensor electrode and a dielectric approaching the operation surface; and a controlling member housed within the inner space and capable of adjusting the sensor electrode to come in contact with the inner surface of the first wall portion.

2. A vehicle door handle apparatus according to claim 1, further comprising;

the door handle having a second wall portion facing the first wall portion, the second wall portion having a second inner surface at an inner side thereof, the second inner surface being a part of a surface defining the inner space of the door handle, wherein the controlling member projects towards the inner space from the second wall portion.

3. A vehicle door handle apparatus according to claim 2, further comprising;

the door handle having both a handle main body, which has the second wall portion and a recessed portion housing the sensor electrode therein, and a cover, which has the first wall portion and fixed to the handle main body so as to close the recessed portion and to define the inner space together with the handle main body.

4. A vehicle door handle apparatus according to claim 3, wherein the controlling member is an elastic member which is in contact with the second inner surface and biases the sensor electrode towards the first inner surface.

5. A vehicle door handle apparatus according to claim 4, further comprising:

the door handle having an antenna assembly which is allocated within the inner space and supports the sensor electrode, wherein one end of the elastic member is in contact with the second inner surface, and an other end thereof is fixed to the antenna assembly, wherein the elastic member is a spring for biasing the sensor electrode together with the antenna assembly towards the first inner surface.

6. A vehicle door handle apparatus according to claim 5, wherein the spring is a coil spring.

7. A vehicle door handle apparatus according to claim 6, wherein the antenna assembly includes an antenna case having at least one flange portion, the at least one flange portion includes at least one pawl by which the coil spring is engaged.

8. A vehicle door handle apparatus according to claim 7, wherein the coil spring biases the antenna assembly to the cover.

9. A vehicle door handle apparatus according to claim 8, wherein the coil spring absorbs a mounting error of the antenna assembly relative to the cover.

10. A vehicle door handle apparatus according to claim 5, wherein the antenna assembly includes an antenna that receives a signal for certifying a user who intends to operate the door handle.

11. A vehicle door handle apparatus according to claim 10, wherein the antenna receives a coded information transmitted from a portable terminal carried with a user who intends to operate the door handle.

12. A vehicle door handle apparatus according to claim 4, wherein the sensor electrode is in contact with the first inner surface with no gap therebetween.

13. A vehicle door handle apparatus according to claim 3, wherein the controlling member absorbs a mounting error of the cover relative to the handle main body.

14. A vehicle door handle apparatus according to claim 3, wherein the cover is made of resin.

15. A vehicle door handle apparatus according to claim 1, wherein the controlling member is engaged to the sensor electrode.

16. A vehicle door handle apparatus according to claim 1, wherein the sensor electrode generates electrostatic capacitance.

17. A vehicle door handle apparatus according to claim 1, wherein the door handle is provided with a door switch for starting-up a door lock operation.

18. A vehicle door handle apparatus according to claim 1, wherein the sensor electrode is supported with good precision relative to the operation surface.

* * * * *